US010792522B2

(12) United States Patent
Santos

(10) Patent No.: US 10,792,522 B2
(45) Date of Patent: Oct. 6, 2020

(54) INTERLOCKING ABRASION-PROTECTION DEVICE FOR LINEMEN FALL-PREVENTION SYSTEMS

(71) Applicant: Aerial Rigging Systems, Inc., Happy Valley, OR (US)

(72) Inventor: Vernie L. Santos, Portland, OR (US)

(73) Assignee: AERIAL RIGGING SYSTEMS, INC., Happy Valley, OR (US)

( * ) Notice: Subject to any disclaimer, the term of this patent is extended or adjusted under 35 U.S.C. 154(b) by 472 days.

(21) Appl. No.: 15/826,380

(22) Filed: Nov. 29, 2017

(65) Prior Publication Data

US 2018/0147426 A1 May 31, 2018

Related U.S. Application Data

(60) Provisional application No. 62/427,442, filed on Nov. 29, 2016.

(51) Int. Cl.
*A62B 35/00* (2006.01)

(52) U.S. Cl.
CPC ..... *A62B 35/005* (2013.01)

(58) Field of Classification Search
CPC .. A62B 1/06; A62B 1/18; A62B 35/00; A62B 35/0043; A62B 35/005; A62B 35/0093; A63B 27/00; A63B 29/02; A63B 29/028; Y10T 24/39; Y10T 24/3916; B66D 1/36
See application file for complete search history.

(56) References Cited

U.S. PATENT DOCUMENTS

| | | | | | |
|---|---|---|---|---|---|
| 504,868 | A * | 9/1893 | Engelke | A62B 1/14 | 182/5 |
| 2,475,339 | A * | 7/1949 | Sandy | F16L 3/1226 | 24/129 R |
| 3,094,755 | A * | 6/1963 | Casanave | F16G 11/046 | 24/129 R |
| 4,311,218 | A * | 1/1982 | Steffen | A62B 1/06 | 182/5 |
| 6,719,243 | B1 * | 4/2004 | Haverty | A62B 1/04 | 242/157 R |
| 8,752,590 | B2 * | 6/2014 | Petty | A63B 29/02 | 138/107 |
| 2011/0272654 | A1 * | 11/2011 | Fay | B65H 57/04 | 254/389 |

* cited by examiner

*Primary Examiner* — Sang K Kim
*Assistant Examiner* — Nathaniel L Adams

(57) ABSTRACT

An interlocking abrasion-protection tool for linemen fall-prevention systems has multiple belay-assistance links which are formed into a chain. The belay-assistance links act as an abrasion-protection sheath for a section of rope that runs over a sharp edge. The belay-assistance links enable a user to lower a lineman who is incapacitated or stuck without endangering other linemen or damaging the linemen-support ropes. To accomplish this, each belay-assistance link has a pair of interlocking mechanisms and multiple rigging channels. The interlocking mechanisms are positioned on opposite sides of the belay-assistance link so that multiple links can be connected in series. The rigging channels traverse through the belay-assistance device to form a raceway for the linemen-protection ropes. The rigging channels prevent the linemen-protection rope from becoming tangled while supporting a lineman.

19 Claims, 8 Drawing Sheets

INTERLOCKING ABRASION-PROTECTION DEVICE FOR LINEMEN FALL-PREVENTION SYSTEMS

The current application claims a priority to the U.S. Provisional Patent application Ser. No. 62/427,442 filed on Nov. 29, 2016.

FIELD OF THE INVENTION

The present invention relates generally to a fall-prevent device. More specifically, the present invention relates to an interlocking fall-prevention device that acts as an abrasion-prevention system for linemen rigging systems.

BACKGROUND OF THE INVENTION

The present invention is a unique interlocking fall-prevention system made of high-density plastic which assembles into a chain. Each link in the present invention is designed with two channels through-which an EN 1891 A Sterline Safety Pro 11.3 mm diameter line is threaded. The present invention can be used with a static line, or as belay system during emergencies. The present invention, placed over rough edges made of steel, aluminum, brick, wood or other material, and allows fall-prevention lines to move freely with minimum friction. Additionally, the present invention allows a third-point of contact in climbs 6 feet AGL (above ground level), as required by OSHA 1910.269 which bans free climbing of towers, buildings and structures. The material used to fabricate the present invention is a custom compound similar to that of traditional Acetal thermoplastic.

The present invention enables a user to link together multiple abrasion-protection devices to create a desired length of rope protection. As a result, the present invention is able to adapt to a wide range of tower structures. The present invention has a one-piece interlocking design which one pin can lock and link each piece together to achieve total rope protection. The present invention is deployed from the ground and installs dual vertical life lines on almost any tower structure. The present invention provides unequalled OSHA compliant rope access along with important built-in rescue features. The present invention can be removed when the job is finished with nothing left behind to be exposed to the weather or to the public.

DETAIL DESCRIPTIONS OF THE INVENTION

Figure 1:
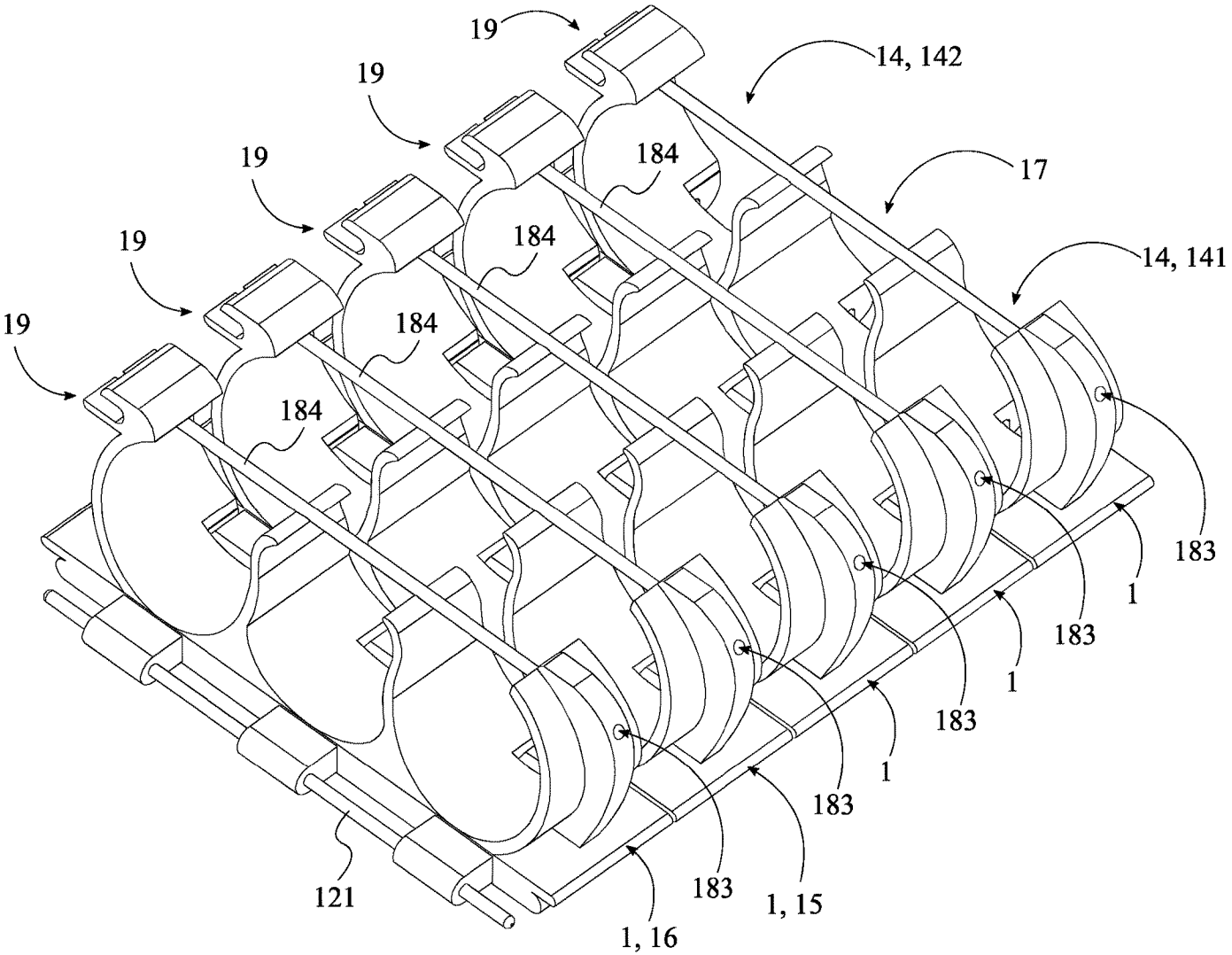
FIG. 1 is a perspective view of a chain formed by linking a plurality of belay assistance links used in the present invention.

All illustrations of the drawings are for the purpose of describing selected versions of the present invention and are not intended to limit the scope of the present invention.

As can be seen in FIG. 1 through FIG. 8, the preferred embodiment of the present invention, the interlocking abrasion-protection device for linemen fall-prevention systems, is a device that enables a user to create a customized fall-prevention system. The present invention is designed to form a linked device that can be positioned over the edge of a transmission tower. Once positioned, the present invention acts as a friction-reducing guide for one or more fall-prevention ropes. That is, the present invention is designed to be a part of a linemen-safety system that ensures the safety of a lineman while the lineman is performing work on a transmission tower. The linemen-safety system comprises a user-operated drone, a plurality of sack line, a pair of linemen-support ropes, and a chain of abrasion-protection devices. To implement the linemen-safety system the user attaches at least one sack line to the user-operated drone. The user then flies the user-operated drone over the transmission tower to position the at least one sack line. Next, the user disconnects the drone and uses the at least one sack line to pull the chain of abrasion-protection devices into place. The user then pulls the pair of linemen-support ropes through the chain of abrasion-protection devices. Either end of the pair of linemen-support ropes can be anchored or routed through belay devices, depending on the task. At this point the linemen-safety system is installed and can be used to prevent the lineman from falling off of the transmission tower. Once the task is completed, the user pulls the chain of abrasion-protection devices off of the transmission tower and retrieves the pair of linemen-support ropes. Although the system for implementing the present invention is described herein as being dedicated to linemen fall-prevention, it is possible to adapt the present invention for use in any area where fall-prevention is required.

As can be seen in FIG. 1 through FIG. 8, the present invention acts as the above-described abrasion-protection device for the linemen-safety system. To accomplish this, the present invention is designed to be an interlocking device that can form a link in a chain which has a user-defined length. Additionally, each link in the chain of abrasion-protection devices is designed with multiple rigging-management channels. When the present invention is formed into a chain of abrasion-protection devices, each rigging-management channel is aligned with corresponding rigging management channels from preceding and subsequent abrasion protection devices to create raceways for the linemen-protection ropes. This enables crews of linemen to install and operate primary linemen-protection ropes and emergency linemen-protection ropes, concurrently. To accomplish this, the present invention comprises a plurality of belay-assistance links 1. Each of the plurality of belay-assistance links 1 acts as a single abrasion-protection device that will be formed into the chain of abrasion-protection devices. Additionally, each of the plurality of belay-assistance links 1 comprises a link body 11, a first interlocking mechanism 12, a second interlocking mechanism 13, and a plurality of rigging channels 14. The link body 11 forms the structural foundation for each of the plurality of belay-assistance links 1, defining the shape of each device. Furthermore, the link body 11 comprises a first lengthwise edge 111 and a second lengthwise edge 112. The first lengthwise edge 111 is positioned opposite to the second lengthwise edge 112, across the link body 11. Additionally, the first lengthwise edge 111 is oriented parallel to the second lengthwise edge 112. As a result, the link body 11 has two straight edges that facilitate a serial connection between the plurality of belay-assistance links 1.

Figure 7:
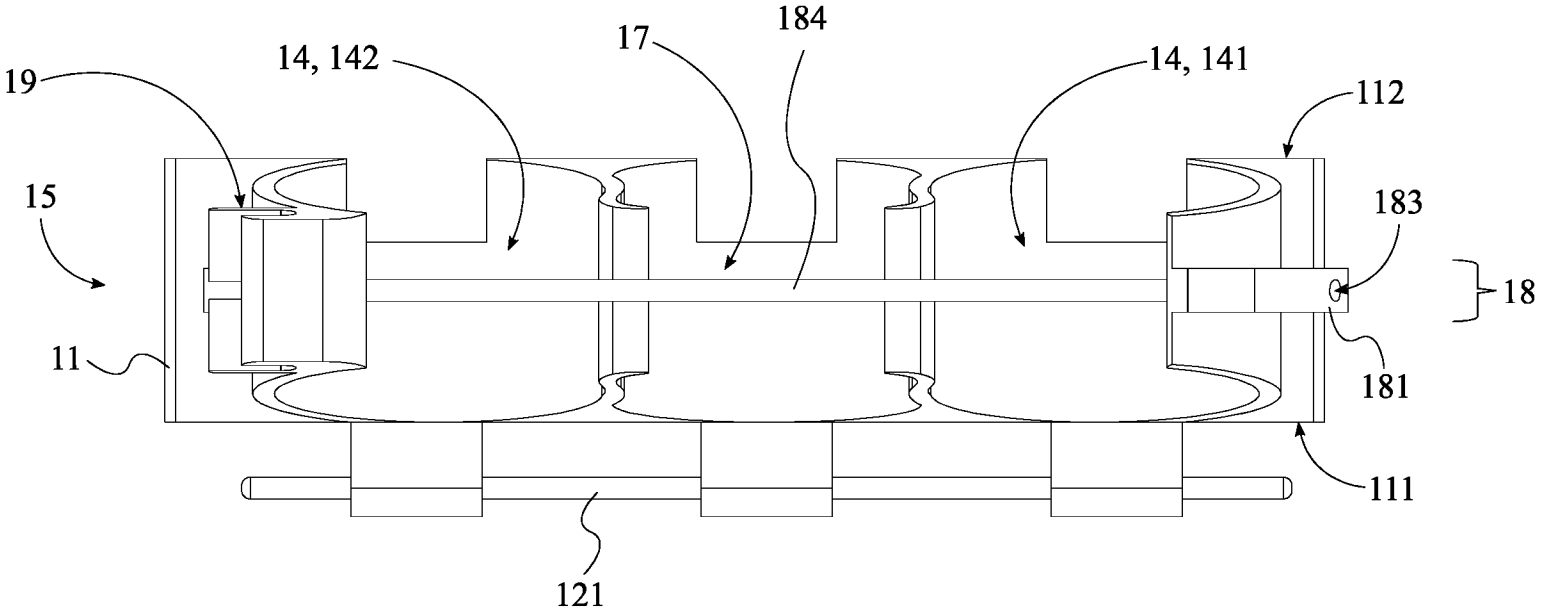
FIG. 7 is a top view of the arbitrary link used in the present invention.
Figure 8:
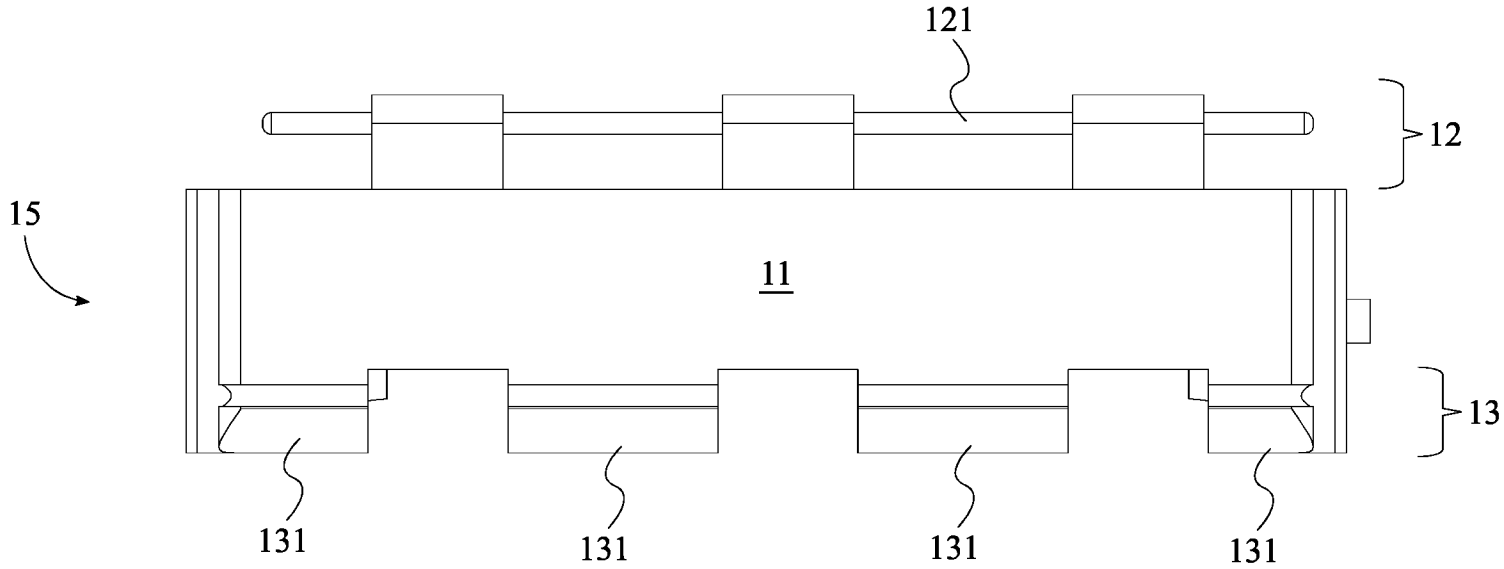
FIG. 8 is a bottom view of the arbitrary link used in the present invention.

As can be seen in FIG. 1, FIG. 7, and FIG. 8, the first lengthwise edge 111 and the second lengthwise edge 112 form the mounting points for the fasteners that are used to form the plurality of belay-assistance links 1 into a chain. To achieve this, the first interlocking mechanism 12 and the second interlocking mechanism 13 are interlocking fasteners that form the connection points between each of the plurality of belay-assistance links 1. Specifically, the first interlocking mechanism 12 is mounted along the first lengthwise edge 111, Conversely, the second interlocking mechanism 13 is mounted along the second lengthwise edge 112. Using this arrangement of components, the first interlocking mechanism 12 of an arbitrary link 15 is hingedly attached to the second interlocking mechanism 13 of an adjacent link 16, wherein the arbitrary link 15 and the adjacent link 16 are from the plurality of belay-assistance links 1. Consequently, the plurality of belay-assistance links 1 is formed into a chain with a length that can be increased or decreased by simply adding or removing any number of adjacent links 16.

As can be seen in FIG. 1, FIG. 7, and FIG. 8, once formed into a chain, the plurality of belay-assistance links 1 can be placed over the beam, or beams, of a transmission tower and used to prevent abrasion between the linemen-protection rope and the beam while the lineman is being belayed. The plurality of rigging channels 14 act as the raceways along which the linemen-protection ropes run while the plurality of belay-assistance links 1 is placed over the beam of the transmission tower. Specifically, the plurality of rigging channels 14 traverses through the link body 11. Additionally, the plurality of rigging channels 14 is oriented perpendicular to the first lengthwise edge 111 and the second lengthwise edge 112. Furthermore, the plurality of rigging channels 14 is distributed across the link body 11. As a result, the plurality of rigging channels 14 enables the linemen-protection ropes to pass through each of the plurality of belay-assistance links 1 without coming into contact with the beam of the transmission tower. Moreover, each of the plurality of rigging channels 14 is designed to accommodate a single linemen-protection rope. Thus, preventing the linemen-protection ropes from becoming tangled.

As can be seen in FIG. 1, FIG. 7, and FIG. 8, the preferred embodiment of the present invention is designed to accommodate two linemen-protection ropes. As such, the plurality of rigging channels 14 comprises a first rigging channel 141 and a second rigging channel 142. Additionally, the first rigging channel 141 of the arbitrary link 15 is concentrically aligned to the first rigging channel 141 of the adjacent link 16 so that a first lineman-protection rope can be threaded through the chain formed by the plurality of belay-assistance links 1. Similarly, the second rigging channel 142 of the arbitrary link 15 is concentrically aligned to the second rigging channel 142 of the adjacent link 16 so that a second linemen-protection rope can be threaded through the chain formed by the plurality of belay-assistance links 1. This configuration gives linemen crews the flexibility to deploy a fall-prevention system with a built-in failsafe. For example, if a lineman who is being belayed on the first linemen-protection rope becomes stuck or incapacitated, the linemen crew can use the second linemen-protection rope to lower the lineman. Alternatively, the linemen crew could use the second linemen-safety rope to send emergency personnel to the incapacitated lineman.

As can be seen in FIG. 1 and FIG. 7, in addition to rigging management, the present invention is designed to enable linemen crews to transport cables and other pieces of equipment from the ground to the lineman being belayed. To accomplish this, each of the plurality of belay-assistance links 1 further comprises a supplementary-equipment channel 17. The supplementary-equipment channel 17 is a channel that enables the lineman to thread a conductor wire or cable through each of the plurality of belay-assistance links 1. Specifically, the supplementary-equipment channel 17 traverses through the link body 11. Additionally, the supplementary-equipment channel 17 is oriented perpendicular to the first lengthwise edge 111 and the second lengthwise edge 112. As a result, the supplementary-equipment channel 17 forms a path through which the conductor wire can pass without coming into contact with the beam of the transmission tower. Furthermore, the supplementary-equipment channel 17 is positioned in between the first rigging channel 141 and the second rigging channel 142. Accordingly, the supplementary-equipment channel 17 facilitates cable management, preventing the conductor wire from becoming tangled with either the first linemen-protection rope or the second linemen-protection rope. Finally, the supplementary-equipment channel 17 of the arbitrary link 15 is concentrically aligned to the supplementary-equipment channel 17 of the adjacent link 16 so that the conductor wire can be threaded through the chain formed by the plurality of belay-assistance links 1. This arrangement enables the supplementary-equipment channel 17 to act as a friction-reducing raceway for the conductor wire.

Figure 2:
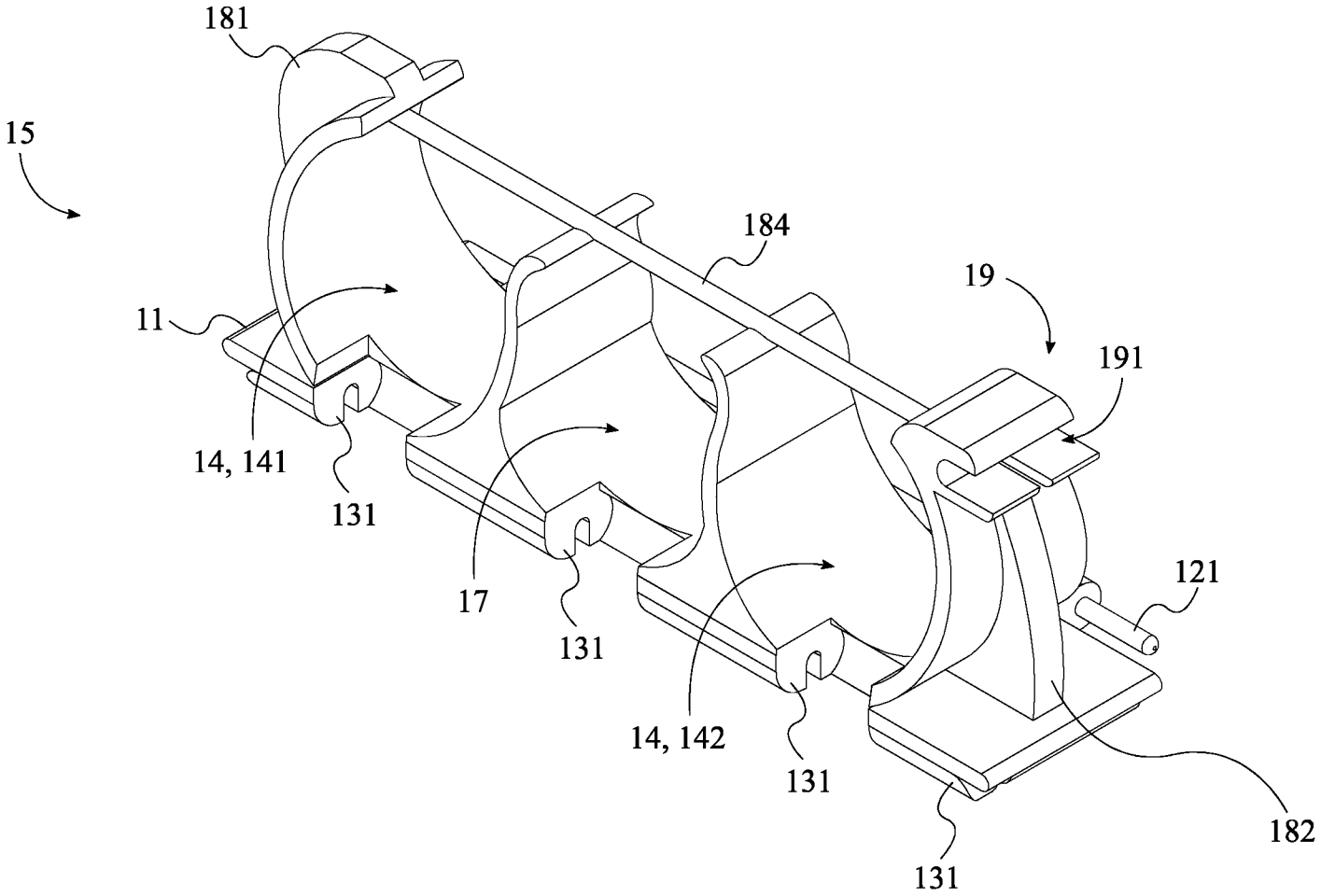
FIG. 2 is a perspective view of an arbitrary link from the plurality of belay assistance links used in the present invention.

As can be seen in FIG. 2 and FIG. 7, the present invention makes use of the first interlocking mechanism 12 and the second interlocking mechanism 13 to form a hinged connection between the plurality of belay-assistance links 1. To achieve this, the first interlocking mechanism 12 comprises an interlock-connection rod 121 and the second interlocking mechanism 13 comprises a plurality of interlock-connection hooks 131. The interlock-connection rod 121 is oriented parallel to the first lengthwise edge 111 of the link body 11. Additionally, the interlock-connection rod 121 is positioned offset from the first lengthwise edge 111 of the link body 11. As a result, the interlock-connection rod 121 acts as the pivot point of the hinged connection established between the first interlocking mechanism 12 of the arbitrary link 15 and the second interlocking mechanism 13 of the adjacent link 16. The plurality of interlock-connection hooks 131 is distributed along the second lengthwise edge 112 of the arbitrary link 15 so that the first interlocking mechanism 12 of the arbitrary link 15 is able to hook onto the second interlocking mechanism 13 of the adjacent link 16. As such, the plurality of interlock-connection hooks 131 is pivotably engaged along the interlock-connection rod 121. Accordingly, the chain formed by the plurality of belay-assistance links 1 is able to bend. Thus, adjusting to the requirements of disparate fall-prevention tasks.

As can be seen in FIG. 1, FIG. 7, and FIG. 8, the present invention enables the user to employ two methods when inserting linemen-protection ropes into the plurality of rigging channels 14. First, the user is able to thread the linemen-protection ropes through each of the plurality of rigging channels 14. Second, the user is able to place the linemen-protection ropes into each of the plurality of rigging channels 14, by disengaging a channel-release device 18 and subsequently reengaging the channel-release device 18. To achieve this second method of use, each of the plurality of belay-assistance links 1 further comprises a channel-release device 18 and a locking mechanism 19. The channel-release device 18 is a rod that extends across an opening of each of the plurality of channels and prevents the linemen-protection ropes from passing through the channel opening without hindering the belaying capabilities of each of the plurality of belay-assistance links 1. Specifically, the channel-release device 18 is mounted across the plurality of rigging channels 14. Additionally, the channel-release device 18 is positioned offset from the first lengthwise edge 111 and the second lengthwise edge 112. As a result, the linemen-protection ropes pass between the channel-release device 18 and a base of each of the plurality of rigging channels 14. This arrangement of components enables longitudinal displacement of the linemen-protection ropes while inhibiting vertical or horizontal displacement of the linemen-protection ropes. The locking mechanism 19 is integrated into the link body 11. Additionally, locking mechanism 19 is operatively coupled to the channel-release device 18, wherein the locking mechanism 19 prevents the channel-release device 18 from becoming disengaged. That is, the locking mechanism 19 prevents the channel-release device 18 from being dismounted from across the plurality of rigging channels 14. Accordingly, the channel-release device 18 can be transitioned between a closed configuration and an opened configuration by engaging or disengaging the locking mechanism 19. Therefore, the user must disengage the locking mechanism 19 to transition the channel-release device 18 into the opened configuration before placing the linemen-protection ropes into the plurality of rigging channels 14.

Figure 3:
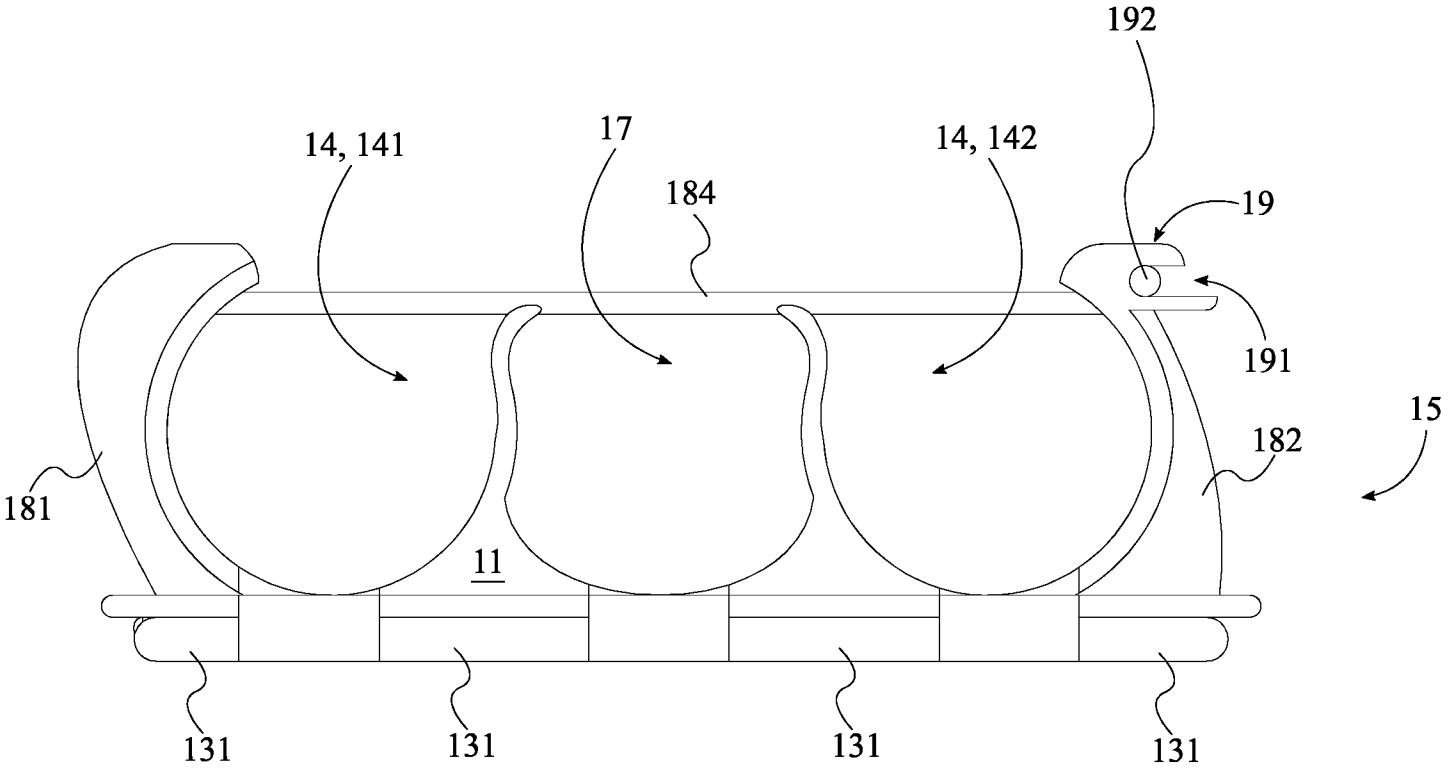
FIG. 3 is a front view of the arbitrary link used in the present invention.
Figure 4:
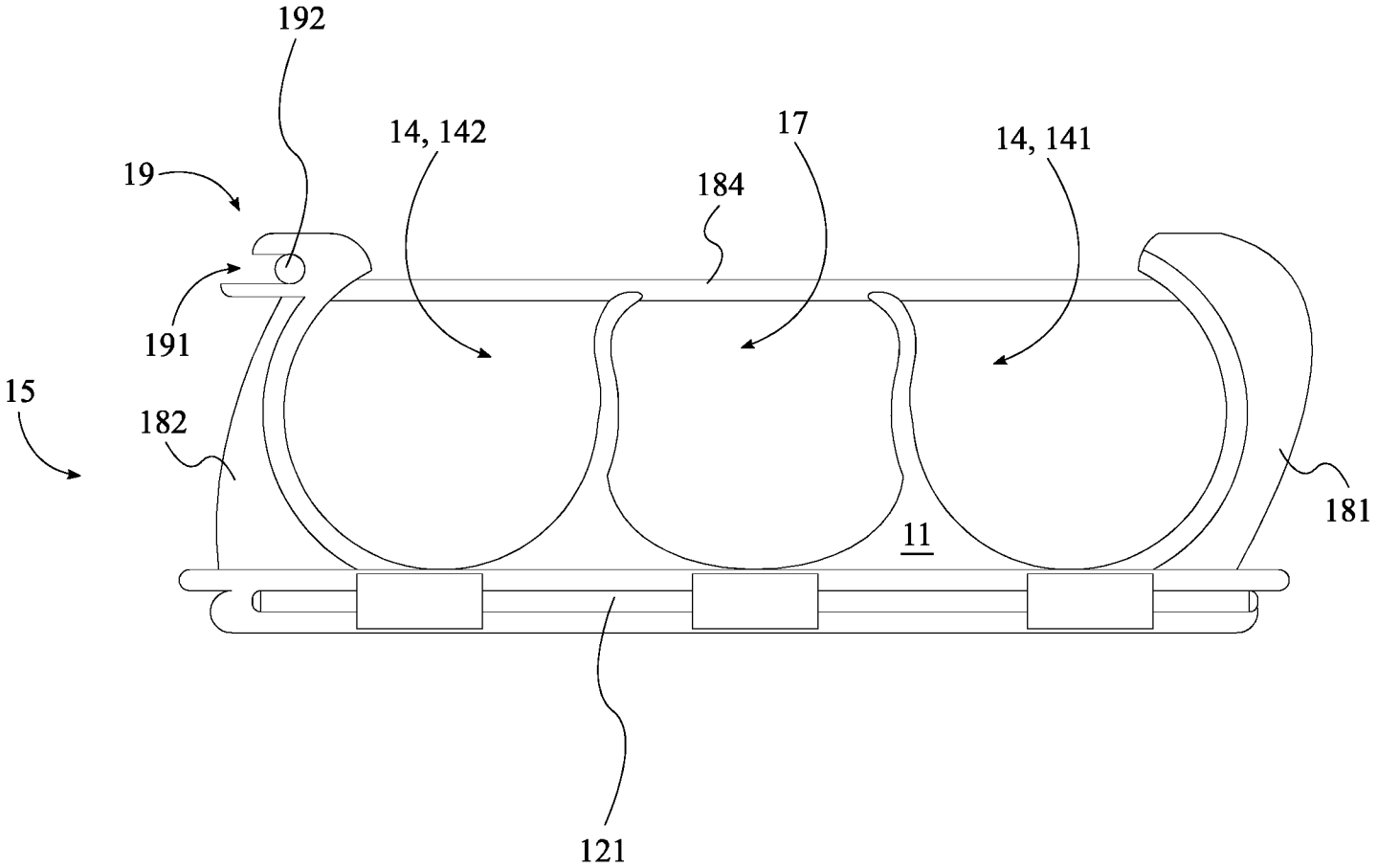
FIG. 4 is a rear view of the arbitrary link used in the present invention.
Figure 5:
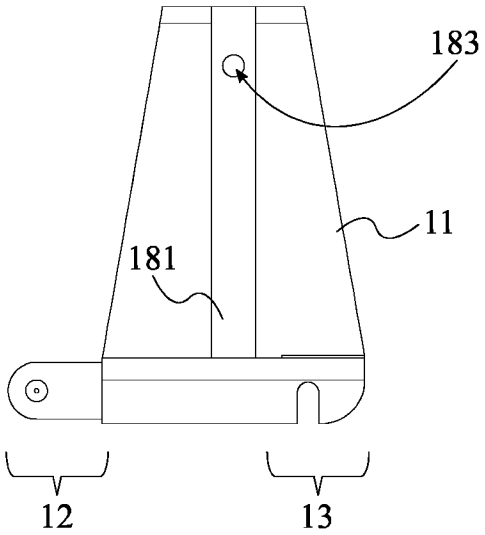
FIG. 5 is a left-side view of the arbitrary link used in the present invention.
Figure 6:
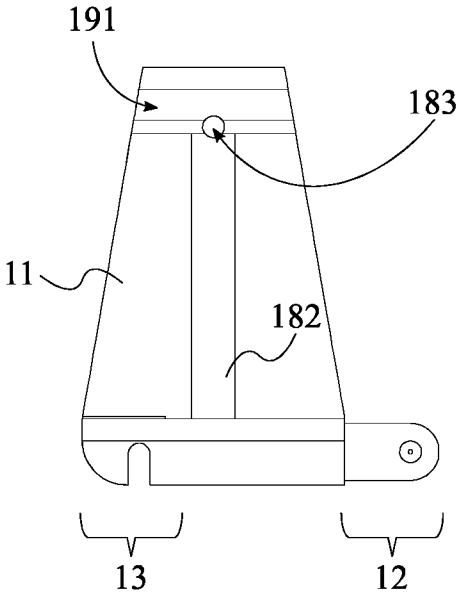
FIG. 6 is a right-side view of the arbitrary link used in the present invention.

As can be seen in FIG. 3, FIG. 7, and FIG. 8, the locking mechanism 19 used in the present invention secures the channel-release device 18 so that the channel-release device 18 cannot become unintentionally dislodged. To accomplish this, the locking mechanism 19 comprises a rod-release slot 191 and a rod-release handle 192. The rod-release slot 191 forms a compartment into which the rod-release handle 192 is inserted when the channel-release device 18 is in the closed configuration. The rod-release slot 191 traverses through the link body 11. Additionally, the rod-release slot 191 is oriented perpendicular to the first lengthwise edge 111 and the second lengthwise edge 112. Furthermore, the rod-release slot 191 is positioned offset from the first lengthwise edge 111 and the second lengthwise edge 112. As a result, the rod-release slot 191 is positioned to receive the rod-release handle 192 and lock the channel-release device 18 in the closed configuration. The rod-release handle 192 is mounted onto the channel-release device 18 so that the user must manipulate the rod-release handle 192 to engage or disengage the locking mechanism 19. Thus, transitioning the channel-release device 18 between the closed or open configuration. When the channel-release device 18 is in the closed configuration the rod-release handle 192 is pressed into the rod-release slot 191. Consequently, the locking mechanism 19 cannot be unintentionally disengaged.

As can be seen in FIG. 3, FIG. 7, and FIG. 8, in the preferred embodiment of the present invention, the channel-release device 18 is a rod that is slid across the plurality of rigging channels 14. To accomplish this, the channel-release device 18 comprises a first mounting bracket 181, a second mounting bracket 182, a mounting hole 183, and a channel-release rod 184. In this embodiment, the plurality of rigging channels 14 is a plurality of semicircular grooves 14. Consequently, the shape of each of the plurality of semicircular grooves 14 reduces the friction between the linemen-protection ropes and the link body 11.

As can be seen in FIG. 3, FIG. 7, and FIG. 8, the first mounting bracket 181 and the second mounting bracket 182 are rigid support members. The first mounting bracket 181 is laterally connected to the link body 11. Similarly, the second mounting bracket 182 is laterally-connected to the link body 11, opposite to the first mounting bracket 181. Additionally, the first mounting bracket 181 and the second mounting bracket 182 are positioned in between the first lengthwise edge 111 and the second lengthwise edge 112.

As a result, the first mounting bracket 181 and the second mounting bracket 182 form support pillars that suspend the channel-release rod 184 over the plurality of rigging channels 14 while the channel-release device 18 is in the closed configuration. To facilitate this, the mounting hole 183 traverses through the first mounting bracket 181 and the second mounting bracket 182. Additionally, the mounting hole 183 is engaged by the channel-release rod 184. Furthermore, the channel-release rod 184 is positioned across an opening of each of the plurality of semicircular grooves 14 Accordingly, the channel-release rod 184 is retained in a position that prevents the linemen-protection ropes from falling out of the plurality of semicircular grooves 14.

As can be seen in FIG. 3, FIG. 7, and FIG. 8, the rod-release handle 192 is terminally connected to the channel-release rod 184. Additionally, channel-release rod 184 is oriented perpendicular to the rod-release handle 192. Thus positioned, the rod-release handle 192 enables the user to manipulate the channel-release rod 184 and selectively engage or disengage the locking mechanism 19. The rod-release slot 191 traverses through the link body 11 and the mounting hole 183. Additionally, the rod-release slot 191 is oriented perpendicular to the mounting hole 183. As a result, the channel-mounting device is coupled to the locking mechanism 19, such that the channel-release rod 184 must pass through the rod-release slot 191 to engage into the mounting hole 183. Additionally, the channel-release rod 184 must be slid through the mounting hole 183 to press the rod-release handle 192 into the rod-release slot 191. In an alternative embodiment, the channel-release device 18 is a rod that is hingedly connected to the link body 11 at a first end and engaged into the locking mechanism 19 at the second end. When the locking mechanism 19 is disengaged, the rod is free to pivot about the hinged connection between the link body 11 and the first end.

Although the invention has been explained in relation to its preferred embodiment, it is to be understood that many other possible modifications and variations can be made without departing from the spirit and scope of the invention as hereinafter claimed.

What is claimed is:

1. An interlocking abrasion-protection tool for linemen fall-prevention systems comprises:

a plurality of belay-assistance links;

each of the plurality of belay-assistance links comprises a link body, a first interlocking mechanism, a second interlocking mechanism, and a plurality of rigging channels;

the link body comprises a first lengthwise edge and a second lengthwise edge;

the first lengthwise edge being positioned opposite to the second lengthwise edge, across the link body;

the first lengthwise edge being oriented parallel to the second lengthwise edge;

the first interlocking mechanism being mounted along the first lengthwise edge;

the second interlocking mechanism being mounted along the second lengthwise edge;

the first interlocking mechanism of an arbitrary link being hingedly attached to the second interlocking mechanism of an adjacent link, wherein the arbitrary link and the adjacent link are from the plurality of belay-assistance links;

the plurality of rigging channels traversing through the link body;

the plurality of rigging channels being oriented perpendicular to the first lengthwise edge and the second lengthwise edge; and the plurality of rigging channels being distributed across the link body.

2. The interlocking abrasion-protection tool for linemen fall-prevention systems as claimed in claim 1 comprises:

the plurality of rigging channels comprises a first rigging channel and a second rigging channel;

the first rigging channel of the arbitrary link being concentrically aligned to the first rigging channel of the adjacent link; and the second rigging channel of the arbitrary link being concentrically aligned to the second rigging channel of the adjacent link.

3. The interlocking abrasion-protection tool for linemen fall-prevention systems as claimed in claim 2 comprises:

each of the plurality of belay-assistance links further comprises a supplementary-equipment channel;

the supplementary-equipment channel traversing through the link body;

the supplementary-equipment channel being oriented perpendicular to the first lengthwise edge and the second lengthwise edge;

the supplementary-equipment channel being positioned in between the first rigging channel and the second rigging channel; and the supplementary-equipment channel of the arbitrary link being concentrically aligned to the supplementary-equipment channel of the adjacent link.

4. The interlocking abrasion-protection tool for linemen fall-prevention systems as claimed in claim 1 comprises:

the first interlocking mechanism comprises an interlock-connection rod;

the second interlocking mechanism comprises a plurality of interlock-connection hooks;

the interlock-connection rod being oriented parallel to the first lengthwise edge of the link body;

the interlock-connection rod being positioned offset from the first lengthwise edge of the link body;

the plurality of interlock-connection hooks being distributed along the second lengthwise edge of the arbitrary link; and the plurality of interlock-connection hooks of the second interlocking mechanism of an arbitrary belay-assistance link among the plurality of belay-assistance links being hingedly engaged along the interlock-connection rod of the first interlocking mechanism of an adjacent belay-assistance link among the plurality of belay-assistance links.

5. The interlocking abrasion-protection tool for linemen fall-prevention systems as claimed in claim 1 comprises:

each of the plurality of belay-assistance links further comprises a channel-release device and a locking mechanism;

the channel-release device being mounted across the plurality of rigging channels;

the channel-release device being positioned offset from the first lengthwise edge and the second lengthwise edge;

the locking mechanism being integrated into the link body; and the locking mechanism being operatively coupled to the channel-release device, wherein the locking mechanism prevents the channel-release device from becoming disengaged.

6. The interlocking abrasion-protection tool for linemen fall-prevention systems as claimed in claim 5 comprises:

the locking mechanism comprises a rod-release slot and a rod-release handle;

the rod-release slot traversing through the link body;

the rod-release slot being oriented perpendicular to the first lengthwise edge and the second lengthwise edge;

the rod-release slot being positioned offset from the first lengthwise edge and the second lengthwise edge;

the rod-rod release handle being mounted onto the channel-release device; and the rod-release handle being pressed into the rod-release slot.

7. The interlocking abrasion-protection tool for linemen fall-prevention systems as claimed in claim 5 comprises:

the channel-release device comprises a first mounting bracket, a second mounting bracket, a mounting hole, and a channel-release rod;

the locking mechanism comprises a rod-release slot and a rod-release handle;

the plurality of rigging channels being a plurality of semicircular grooves;

the first mounting bracket being laterally connected to the link body;

the second mounting bracket being laterally-connected to the link body, opposite to the first mounting bracket;

the first mounting bracket and the second mounting bracket being positioned in between the first lengthwise edge and the second lengthwise edge;

the mounting hole traversing through the first mounting bracket and the second mounting bracket;

the mounting hole being engaged by the channel-release rod;

the channel-release rod being positioned across an opening of each of the plurality of semicircular grooves;

the rod-release handle being terminally connected to the channel-release rod;

the channel-release rod being oriented perpendicular to the rod-release handle;

the rod-release slot traversing through the link body and the mounting hole;

the rod-release slot being oriented perpendicular to the mounting hole; and the rod-release handle being pressed into the rod-release slot.

8. An interlocking abrasion-protection tool for linemen fall-prevention systems comprises:

a plurality of belay-assistance links;

each of the plurality of belay-assistance links comprises a link body, a first interlocking mechanism, a second interlocking mechanism, and a plurality of rigging channels;

the link body comprises a first lengthwise edge and a second lengthwise edge;

the first lengthwise edge being positioned opposite to the second lengthwise edge, across the link body;

the first interlocking mechanism comprises an interlock-connection rod;

the second interlocking mechanism comprises a plurality of interlock-connection hooks;

the first lengthwise edge being oriented parallel to the second lengthwise edge;

the first interlocking mechanism being mounted along the first lengthwise edge;

the second interlocking mechanism being mounted along the second lengthwise edge;

the first interlocking mechanism of an arbitrary link being hingedly attached to the second interlocking mechanism of an adjacent link, wherein the arbitrary link and the adjacent link are from the plurality of belay-assistance links, the interlock-connection rod being oriented parallel to the first lengthwise edge of the link body;

the interlock-connection rod being positioned offset from the first lengthwise edge of the link body;

the plurality of interlock-connection hooks being distributed along the second lengthwise edge of the arbitrary link;

the plurality of interlock-connection hooks of the second interlocking mechanism of an arbitrary belay-assistance link among the plurality of belay-assistance links being hingedly engaged along the interlock-connection rod of the first interlocking mechanism of an adjacent belay-assistance link among the plurality of belay-assistance links;

the plurality of rigging channels traversing through the link body;

the plurality of rigging channels being oriented perpendicular to the first lengthwise edge and the second lengthwise edge; and the plurality of rigging channels being distributed across the link body.

9. The interlocking abrasion-protection tool for linemen fall-prevention systems as claimed in claim 8 comprises:

the plurality of rigging channels comprises a first rigging channel and a second rigging channel;

the first rigging channel of the arbitrary link being concentrically aligned to the first rigging channel of the adjacent link; and the second rigging channel of the arbitrary link being concentrically aligned to the second rigging channel of the adjacent link.

10. The interlocking abrasion-protection tool for linemen fall-prevention systems as claimed in claim 9 comprises:

each of the plurality of belay-assistance links further comprises a supplementary-equipment channel;

the supplementary-equipment channel traversing through the link body;

the supplementary-equipment channel being oriented perpendicular to the first lengthwise edge and the second lengthwise edge;

the supplementary-equipment channel being positioned in between the first rigging channel and the second rigging channel; and the supplementary-equipment channel of the arbitrary link being concentrically aligned to the supplementary-equipment channel of the adjacent link.

11. The interlocking abrasion-protection tool for linemen fall-prevention systems as claimed in claim 8 comprises:

each of the plurality of belay-assistance links further comprises a channel-release device and a locking mechanism;

the channel-release device being mounted across the plurality of rigging channels;

the channel-release device being positioned offset from the first lengthwise edge and the second lengthwise edge;

the locking mechanism being integrated into the link body; and the locking mechanism being operatively coupled to the channel-release device, wherein the locking mechanism prevents the channel-release device from becoming disengaged.

12. The interlocking abrasion-protection tool for linemen fall-prevention systems as claimed in claim 11 comprises:

the locking mechanism comprises a rod-release slot and a rod-release handle;

the rod-release slot traversing through the link body;

the rod-release slot being oriented perpendicular to the first lengthwise edge and the second lengthwise edge;

the rod-release slot being positioned offset from the first lengthwise edge and the second lengthwise edge;

the rod-rod release handle being mounted onto the channel-release device; and the rod-release handle being pressed into the red-release slot.

13. The interlocking abrasion-protection tool for linemen fall-prevention systems as claimed in claim 11 comprises:

the channel-release device comprises a first mounting bracket, a second mounting bracket, a mounting hole, and a channel-release rod;

the locking mechanism comprises a rod-release slot and a rod-release handle;

the plurality of rigging channels being a plurality of semicircular grooves;

the first mounting bracket being laterally connected to the link body;

the second mounting bracket being laterally-connected to the link body, opposite to the first mounting bracket;

the first mounting bracket and the second mounting bracket being positioned in between the first lengthwise edge and the second lengthwise edge;

the mounting hole traversing through the first mounting bracket and the second mounting bracket;

the mounting hole being engaged by the channel-release rod;

the channel-release rod being positioned across an opening of each of the plurality of semicircular grooves;

the rod-release handle being terminally connected to the channel-release rod;

the channel-release rod being oriented perpendicular to the rod-release handle;

the rod-release slot traversing through the link body and the mounting hole;

the rod-release slot being oriented perpendicular to the mounting hole; and the rod-release handle being pressed into the rod-release slot.

14. An interlocking abrasion-protection tool for linemen fall-prevention systems comprises:

a plurality of belay-assistance links;

each of the plurality of belay-assistance links comprises a link body, a first interlocking mechanism, a second interlocking mechanism, and a plurality of rigging channels;

the link body comprises a first lengthwise edge and a second lengthwise edge;

the plurality of rigging channels comprises a first rigging channel and a second rigging channel;

the first lengthwise edge being positioned opposite to the second lengthwise edge, across the link body;

the first lengthwise edge being oriented parallel to the second lengthwise edge;

the first interlocking mechanism being mounted along the first lengthwise edge;

the second interlocking mechanism being mounted along the second lengthwise edge;

the first interlocking mechanism of an arbitrary link being hingedly attached to the second interlocking mechanism of an adjacent link, wherein the arbitrary link and the adjacent link are from the plurality of belay-assistance links, the plurality of rigging channels traversing through the link body;

the plurality of rigging channels being oriented perpendicular to the first lengthwise edge and the second lengthwise edge;

the plurality of rigging channels being distributed across the link body;

the first rigging channel of the arbitrary link being concentrically aligned to the first rigging channel of the adjacent link; and the second rigging channel of the arbitrary link being concentrically aligned to the second rigging channel of the adjacent link.

15. The interlocking abrasion-protection tool for linemen fall-prevention systems as claimed in claim 14 comprises:

each of the plurality of belay-assistance links further comprises a supplementary-equipment channel;

the supplementary-equipment channel traversing through the link body;

the supplementary-equipment channel being oriented perpendicular to the first lengthwise edge and the second lengthwise edge;

the supplementary-equipment channel being positioned in between the first rigging channel and the second rigging channel; and the supplementary-equipment channel of the arbitrary link being concentrically aligned to the supplementary-equipment channel of the adjacent link.

16. The interlocking abrasion-protection tool for linemen fall-prevention systems as claimed in claim 14 comprises:

the first interlocking mechanism comprises an interlock-connection rod;

the second interlocking mechanism comprises a plurality of interlock-connection hooks;

the interlock-connection rod being oriented parallel to the first lengthwise edge of the link body;

the interlock-connection rod being positioned offset from the first lengthwise edge of the link body;

the plurality of interlock-connection hooks being distributed along the second lengthwise edge of the arbitrary link; and the plurality of interlock-connection hooks of the second interlocking mechanism of an arbitrary belay-assistance link among the plurality of belay-assistance links being hingedly engaged along the interlock-connection rod of the first interlocking mechanism of an adjacent belay-assistance link among the plurality of belay-assistance links.

17. The interlocking abrasion-protection tool for linemen fall-prevention systems as claimed in claim 14 comprises:

each of the plurality of belay-assistance links further comprises a channel-release device and a locking mechanism;

the channel-release device being mounted across the plurality of rigging channels;

the channel-release device being positioned offset from the first lengthwise edge and the second lengthwise edge;

the locking mechanism being integrated into the link body; and the locking mechanism being operatively coupled to the channel-release device, wherein the locking mechanism prevents the channel-release device from becoming disengaged.

18. The interlocking abrasion-protection tool for linemen fall-prevention systems as claimed in claim 17 comprises:

the locking mechanism comprises a rod-release slot and a rod-release handle;

the rod-release slot traversing through the link body;

the rod-release slot being oriented perpendicular to the first lengthwise edge and the second lengthwise edge;

the rod-release slot being positioned offset from the first lengthwise edge and the second lengthwise edge;

the rod-rod release handle being mounted onto the channel-release device; and the rod-release handle being pressed into the red-release slot.

19. The interlocking abrasion-protection tool for linemen fall-prevention systems as claimed in claim 17 comprises:

the channel-release device comprises a first mounting bracket, a second mounting bracket, a mounting hole, and a channel-release rod;

the locking mechanism comprises a rod-release slot and a rod-release handle;

the plurality of rigging channels being a plurality of semicircular grooves;

the first mounting bracket being laterally connected to the link body;

the second mounting bracket being laterally-connected to the link body, opposite to the first mounting bracket;

the first mounting bracket and the second mounting bracket being positioned in between the first lengthwise edge and the second lengthwise edge;

the mounting hole traversing through the first mounting bracket and the second mounting bracket;

the mounting hole being engaged by the channel-release rod;

the channel-release rod being positioned across an opening of each of the plurality of semicircular grooves;

the rod-release handle being terminally connected to the channel-release rod;

the channel-release rod being oriented perpendicular to the rod-release handle;

the rod-release slot traversing through the link body and the mounting hole;

the rod-release slot being oriented perpendicular to the mounting hole; and the rod-release handle being pressed into the rod-release slot.

* * * * *